United States Patent [19]

Bernard et al.

[11] 4,306,624

[45] Dec. 22, 1981

[54] SYSTEM FOR PREVENTING HYDRATE PLUG FORMATION IN GAS WELLS

[75] Inventors: William F. Bernard; David I. Wilkie; William J. Cooke, all of Calgary, Canada

[73] Assignee: Dome Petroleum Limited, Calgary, Canada

[21] Appl. No.: 102,420

[22] Filed: Dec. 11, 1979

Related U.S. Application Data

[63] Continuation-in-part of Ser. No. 928,570, Jul. 27, 1978, abandoned.

[30] Foreign Application Priority Data

Jul. 29, 1977 [CA] Canada ..... 283737

[51] Int. Cl.[3] ..... E21B 43/12; E21B 41/00

[52] U.S. Cl. ..... 166/336; 166/244 C; 166/310

[58] Field of Search ..... 166/310, 336, 244 C

[56] References Cited

U.S. PATENT DOCUMENTS

| | | | |
|---|---|---|---|
| 2,293,442 | 8/1942 | Montgomery | 166/310 |
| 3,096,819 | 7/1963 | White et al. | 166/310 |
| 3,335,791 | 8/1967 | Patton | 166/310 |
| 3,348,614 | 10/1967 | Sinclair et al. | 166/310 |
| 3,548,946 | 12/1970 | Engle | 166/310 |
| 4,116,272 | 9/1978 | Barrington | 166/310 |

OTHER PUBLICATIONS

Petroleum Production Engineering, 3rd Ed. by Owen, 1953, McGraw Hill Book Co., pp. 600–602.

The Oil & Gas Journal, vol. 65, No. 6, Feb. 6, 1967, pp. 81–86.

*Primary Examiner*—James A. Leppink

*Attorney, Agent, or Firm*—Shlesinger, Arkwright, Garvey & Dinsmore

[57] ABSTRACT

A modification is provided in an assembly for use in an offshore well test string during oil or gas tests on exploration wells. The well has a well bore and a test string with a subsea test tree located in the vicinity of the subsea blowout preventor at the sea floor. The modified assembly includes at least one line having one end in communication with a supply of methanol and the other end in communication with the test string below the sea floor. The line is substantially parallel to the test string and includes the following combination: upper and lower external tubing protectors mechanically associated with the external tubing and the production string; internal porting of selected sections of the subsea test tree, thereby not interrupting the functional use of any component; a pin and box connector detachably connecting the upper external tubing to the upper internal portion; and a lower methanol injection check valve disposed below the sea floor for admitting methanol into the test string while providing a bubble-tight seal against well fluids. A method is thus disclosed of preventing hydrate plug formation in production testing of oil and gas wells by injecting methanol into the test string of the well at any desired depth at an injection rate of at least 1.0 g pm.

15 Claims, 11 Drawing Figures

| |
|---|
| FIG.2A |
| FIG.2B |
| FIG.2C |
| FIG.2D |
| FIG.2E |
| FIG.2F |
| FIG.2G |
| FIG.2H |

SYSTEM FOR PREVENTING HYDRATE PLUG FORMATION IN GAS WELLS

This application is a continuation-in-part of application Ser. No. 928,570, filed July 27, 1978, now abandond.

BACKGROUND OF THE INVENTION

This invention relates to a method and system for preventing the formation of hydrate plugs in the well test string during oil or gas tests on subsea exploration wells.

It is known that at low temperatures hydrate plugs (similar to but not ice) may form in wells during oil or gas tests. It is known that the injection of a freezing point depressant, i.e. methanol, downhole will effectively prevent hydrate plug formation. While systems for injecting a freezing point depressant in land wells are known, certain problems exist in carrying out such injection in offshore wells. These problems are inherent with many problems associated with off-shore testing.

SUMMARY OF THE INVENTION

It is therefore an object of a broad aspect of this invention to provide a sub-sea testing system for oil and gas testing of offshore exploration wells.

An object of another aspect of this invention is to provide a freezing point depressant injection system which is compatible with the operation of the current subsea equipment and does not jeopardize the present pressure integrity or the functional capability of the subsea test tree, the subsea blowout preventors or the test string.

According to a broad aspect of this invention, the system is provided with an assembly connected to a well intended to produce oil or gas, the well having a well bore and a test string with a subsea test tree in the vicinity of a subsea blowout preventor at the sea floor. The assembly includes at least one line having one end in communication with a supply of a freezing point depressant and having the other end in communication with the production string below said sea floor. The line is substantially parallel to the test string and includes the combination of: upper and lower external tubing; tubing protectors mechanically associated with the external tubing and the test string; internal porting of selected sections of the sub-sea test tree, thereby not interrupting the functional use of any component; unlatch/latch connection means, e.g., a pin and box connector to detachably connect the upper external tubing to the upper extent of the internal porting; and a lower freezing point depressant injection check valve disposed below said sea floor for admitting freezing point depressant into the test string while providing a substantially bubble-tight seal against well fluids.

By one variant, the connections between the external tubing and the internal porting are of a static resilient and mechanical type seals.

By another variant, tubing protectors are provided in the vicinity of the test string joints; the tubing protectors preferably are provided immediately above and immediately below the production string joints and between the joints.

By yet another variant, the check valve is a dual, fail closed valve; the valve preferably is contained in a protective housing disposed within the well casing; the connection to the injection tubing is still furthermore protected from vertical and side impacts and is provided with a resilient static seal.

By still another variant, the assembly includes means for plugging at least one injection port in the freezing point depressant flow path system in the event of mechanical failure in the injection system.

By another variant, the freezing point depressant used is methanol.

By another aspect of this invention, a method is provided for preventing hydrate plug formation in production testing of an offshore oil and gas well having a test string extending therethrough and including a subsea test tree, the method comprising: providing a line having one end in communication with a supply of a freezing point depressant and having the other end in communication with the test string below the sea floor, the line comprising upper and lower external tubing and internal porting of selected intermediate sections of the subsea test tree; and, injecting the freezing point depressant through the line into the test string of the well below the sea floor.

By one variant, a method of preventing hydrate plug formation in production testing of offshore oil and gas wells having a subsea test tree is provided which comprises injecting methanol into the test string of the well at any selected depth beneath the subsea test tree at an injection rate of at least 1.0 g pm.

BRIEF DESCRIPTION OF THE DRAWINGS

In the accompanying drawings.

DESCRIPTION OF THE PREFERRED EMBODIMENTS

Figure 1:
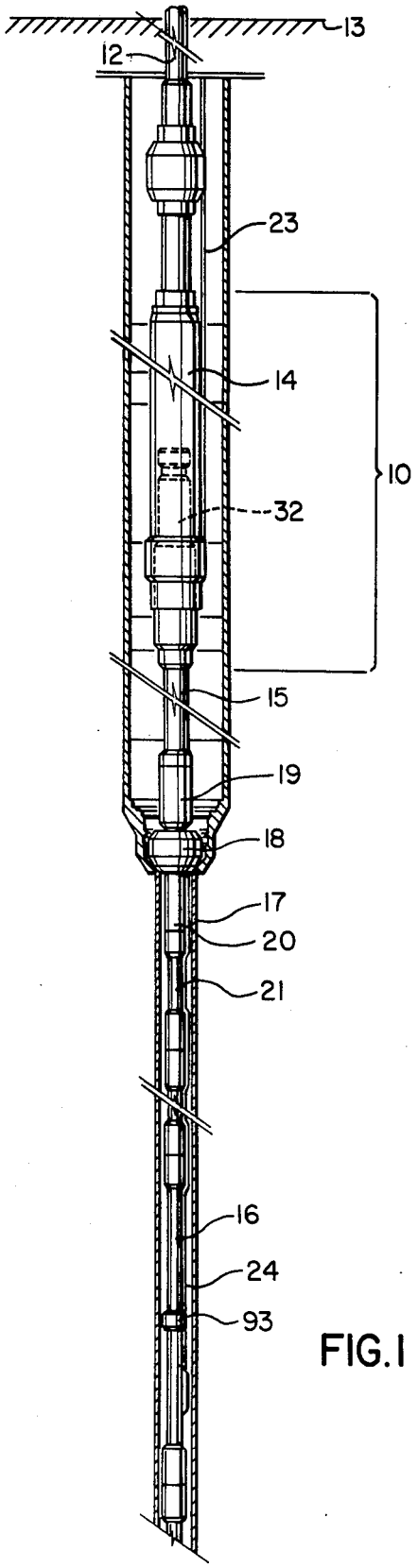
FIG. 1 is a schematic side elevation of the sub-sea test tree.

The accompanying drawing of FIG. 1 shows a view of a sub-sea test tree 10. The test string includes a supporting conduit 12 extending down from the surface located rig floor 13, sub-sea tree valve assembly 14, a lower sub-sea tree mandrel 30 and a slick joint 15 secured to the supporting conduit 12 and carrying a downhole test string 16. Test string 16 is supported within the well casing 17 by a hanger 18, provided with an upper sub 19, a lower sub 20 and a cross over sub 21. The downhole test string 16 extends into the well hole to the vicinity of the formation test interval. The freezing point depressant injection system includes the combination of upper external tubing 23, intermediate internal conduits or porting to be described in greater detail hereinater with respect to composite FIG. 2, and lower external tubing 24. The external tubing 23 and 24 are secured to the respective supporting conduit 12 and 16 in a protected manner, as by the use of conventional tubing protectors.

While any appropriate freezing point depressant may be used, methanol is preferred.

Figure 2A:
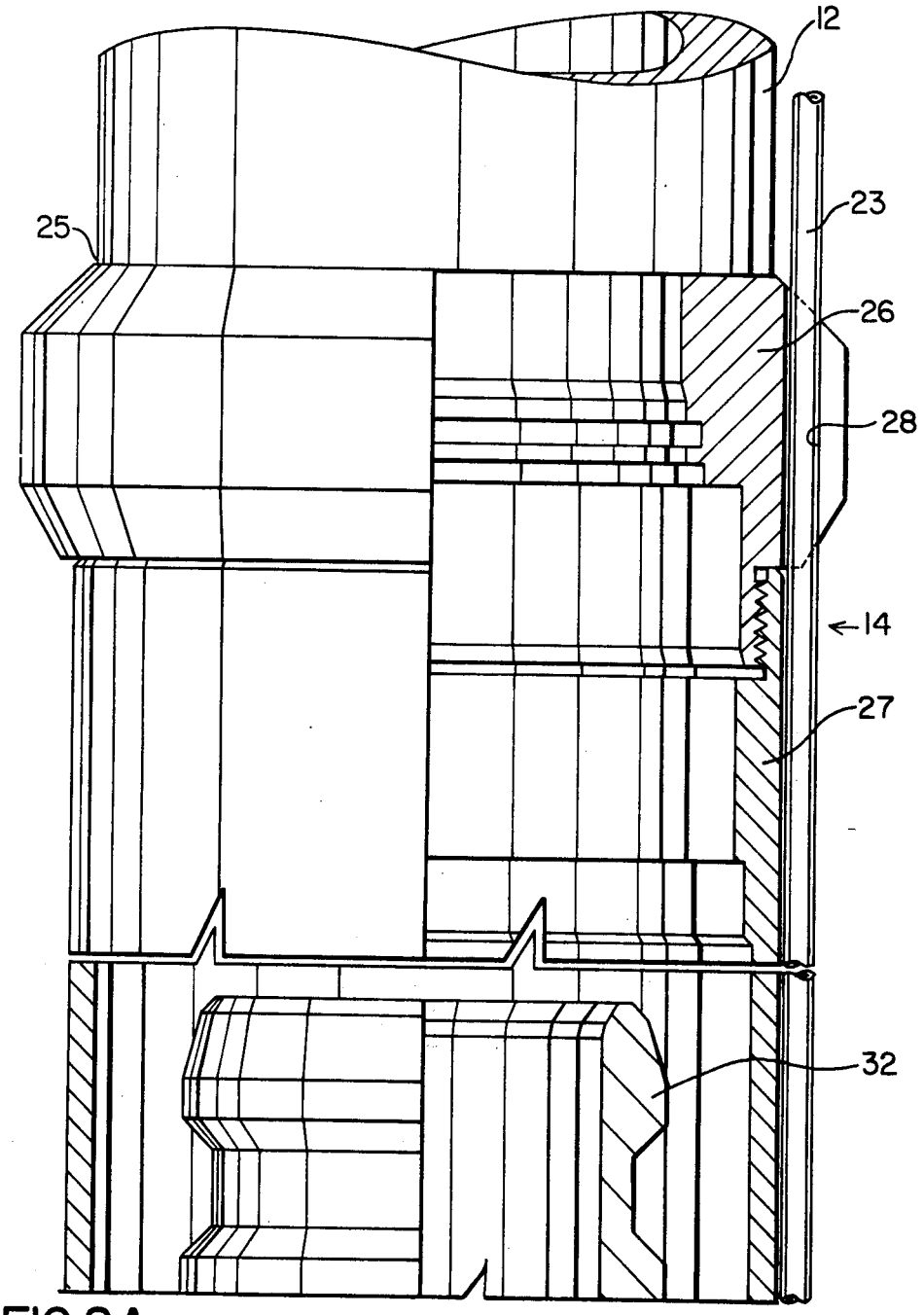
FIG. 2 is a composite comprising FIGS. 2A, 2B, 2C, 2D, 2E, 2F, 2G, and 2H which provide a longitudinal half cross-section, half side elevation of parts of the test tree of FIG. 1 with FIG. 2I being the schematic representation of the interrelationship of FIGS. 2A–2H.
Figure 2B:
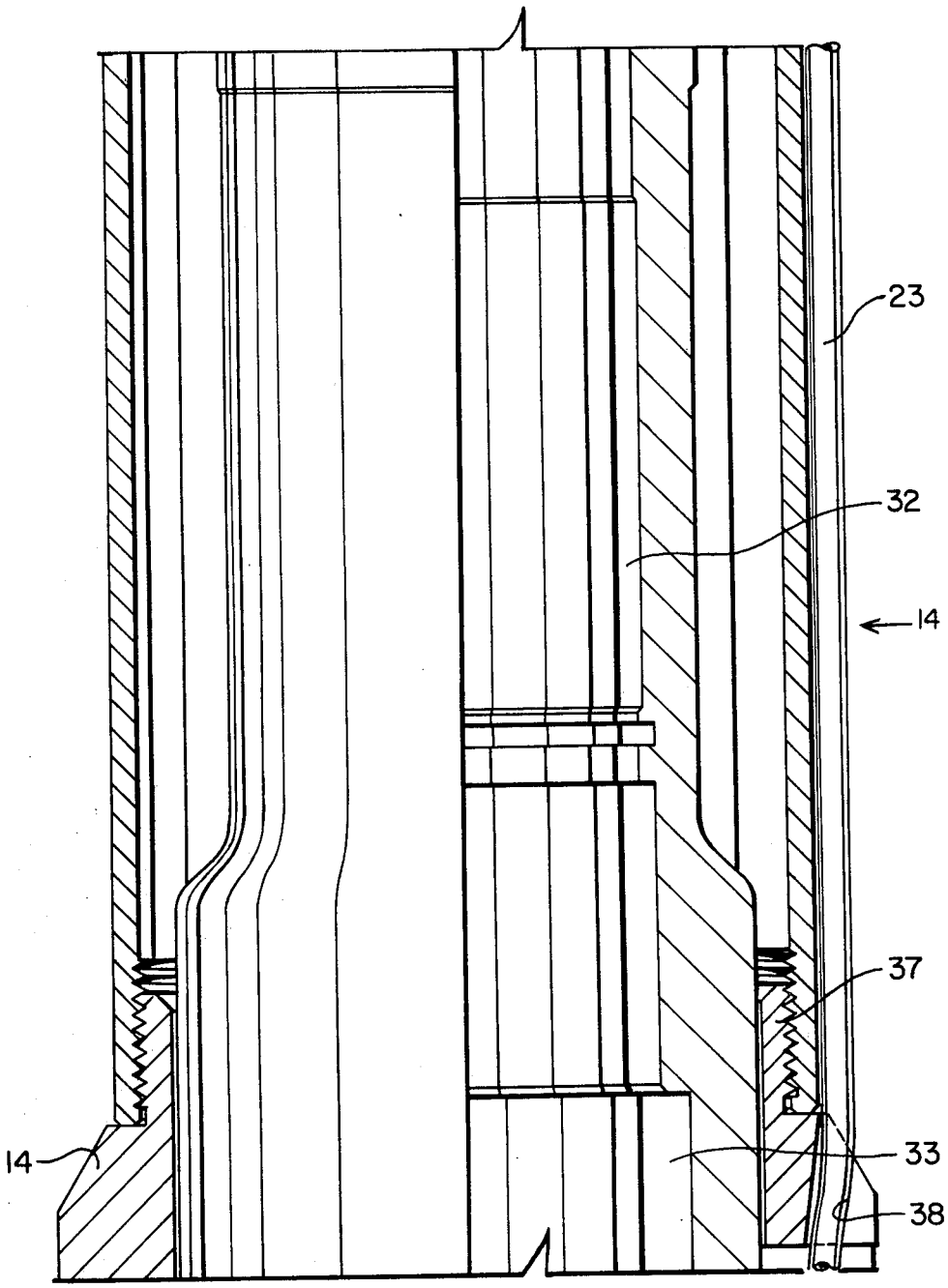
Figure 2C:
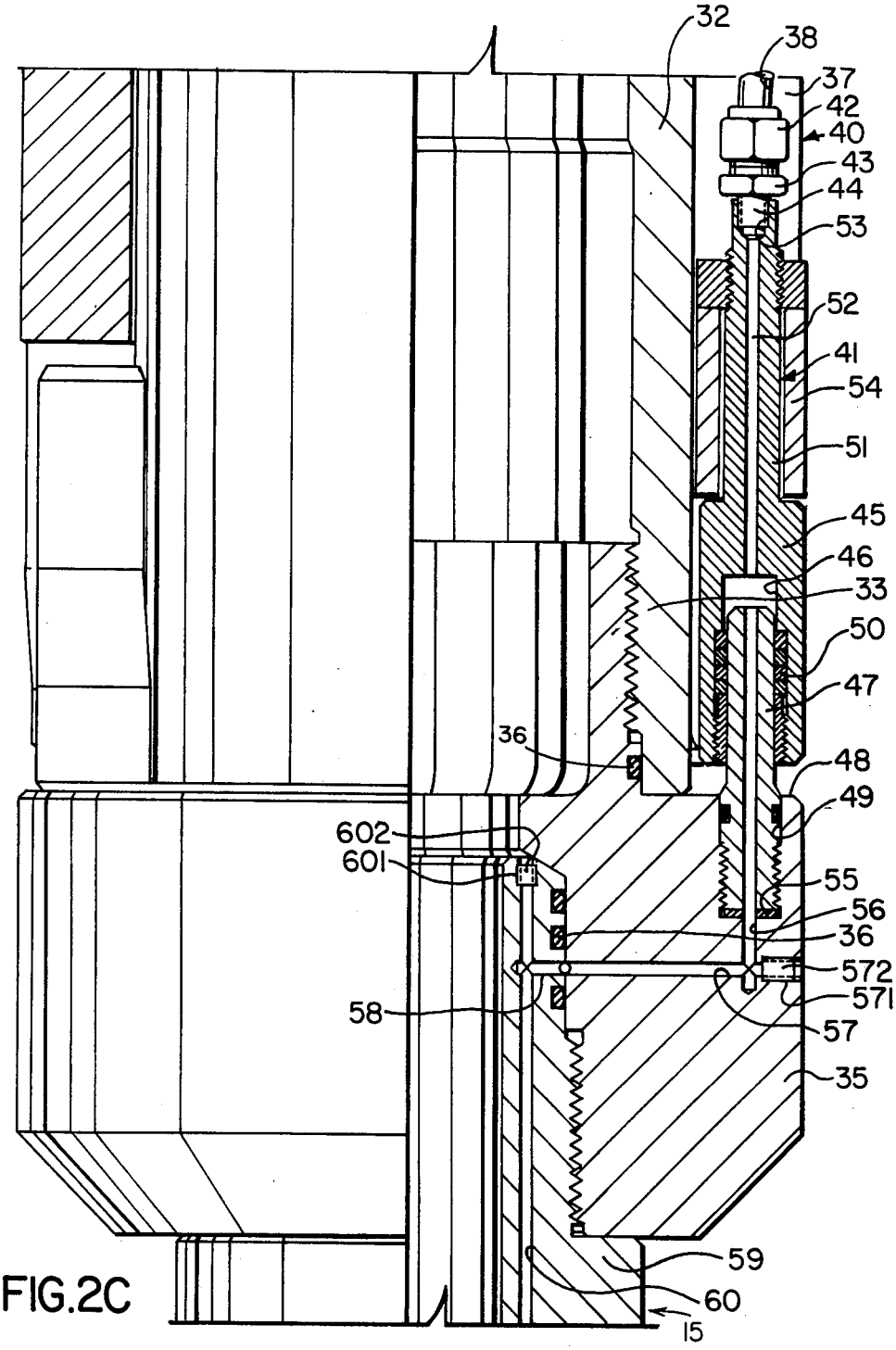
Figure 2D:
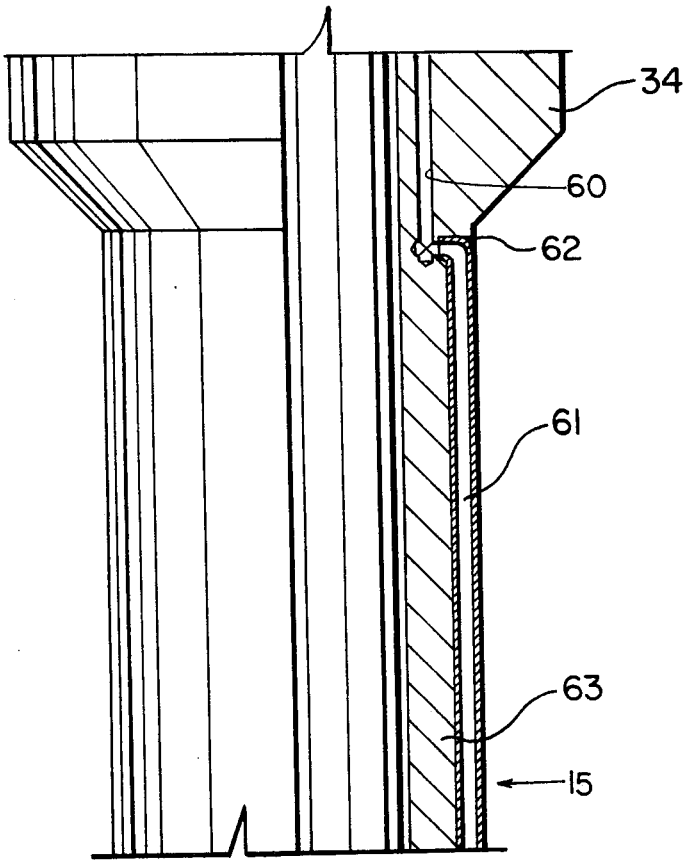
Figure 2D:
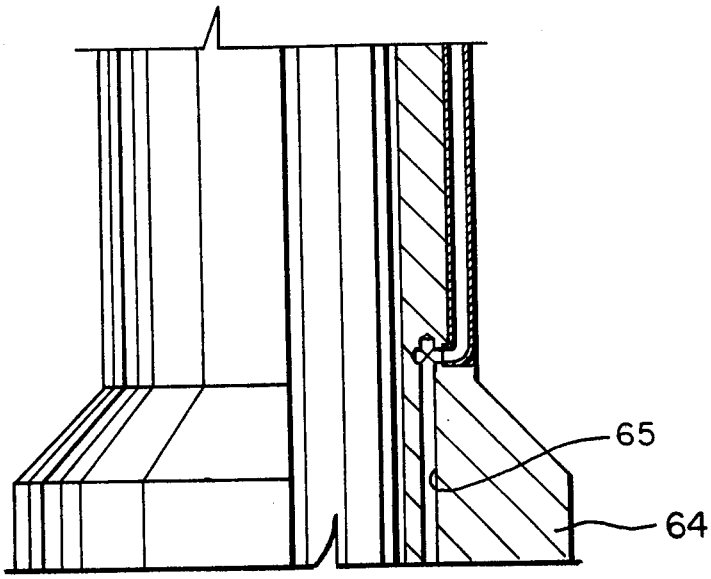
Figure 3:
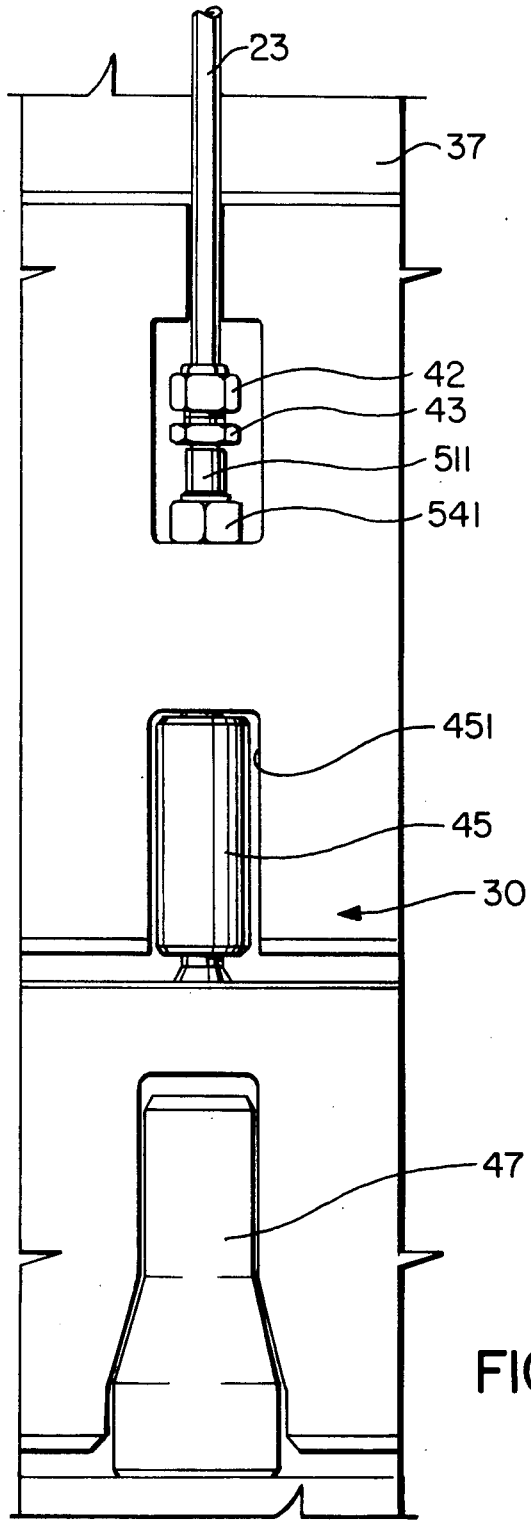
FIG. 3 is a side elevation of the pin and box connector and housing.

As seen in FIG. 2A, secured to the bottom 25 of the supporting conduit 12 is an upper sub-sea tree assembly including a protective centralizer 26, an upper housing and lower protective housing 37. The centralizer 26 is longitudinally slotted at 28 to permit the external tubing 23 to pass therethrough. The tubing 23 extends externally down the side of the upper sub-sea tree valve assembly 14 and interconnects with a lower sub-sea tree assembly through the use of a double dimensioned keying system 47 (see FIG. 3). The lower sub-sea tree assembly includes an upper mandrel 32 terminating in a lower housing 33 (FIG. 2B). The housing 33 of the lower sub-sea tree assembly is connected to a slick joint 15 by straight threads (FIG. 2C). Suitable packings 36 are provided to assure a fluid-tight fit.

The valve assembly 14 (FIG. 2B) is generally cylindrical. An axial slot 38 is provided to allow access for the external tubing 23 through the housing 37 to a pin and box connector assembly 40 with the box connector protectively disposed within the housing 37 (FIG. 2C).

The connector assembly 40 includes a terminal nut assembly 42 and 43 to connect the upper external tubing 23 to the box connector 41.

The methanol box connector 41 includes a cylindrical enveloping box 45 having an internal pocket 46 which connects to a pin nipple 47 projecting upwardly from an exposed shoulder 48 of the collar lower housing 33. The nipple 47 is sealed into a well 49 in the lower housing in the usual manner to prevent fluid leaks. In addition, the connection between the internal pocket 46 of the box 45 and the nipple 47 is provided with conventional sealing packings 50 to prevent fluid leaks. The cylindrical box 45 is provided with an upwardly extending, connecting tube 51 having a longitudinal port 52 which terminates in threads 53 within which the pin end 44 of the nut assembly 42 at the lower end of the external tubing 23 is secured. The connecting tube 51 is mounted within the lower end of protective housing 37. By means of the box connector 41 and the pin nipple 47 the upper external tubing 23 is detachably connected to the upper extent of the internal conduits or porting to be described.

Figure 2E:
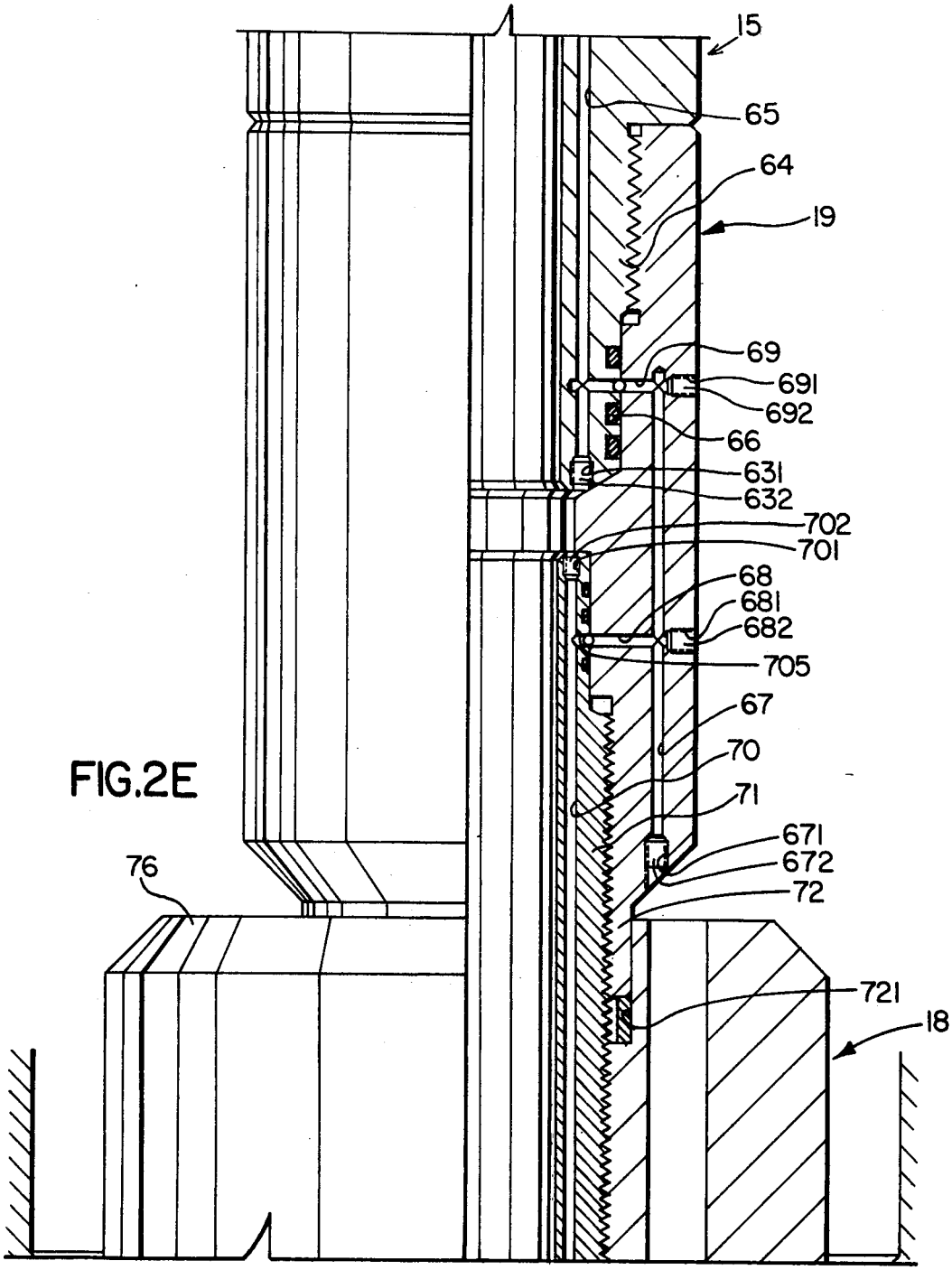
Figure 2F:
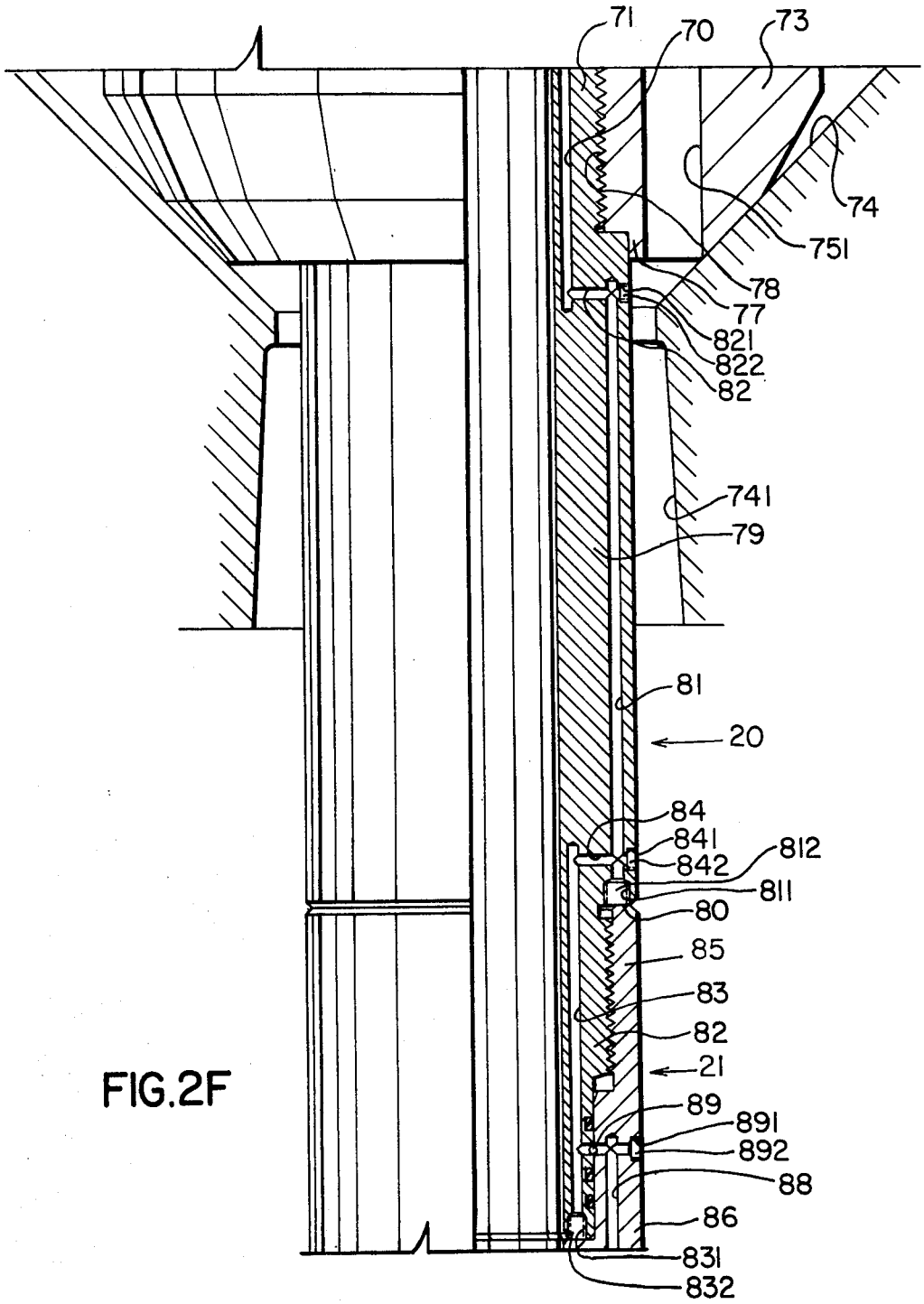
Figure 2G:
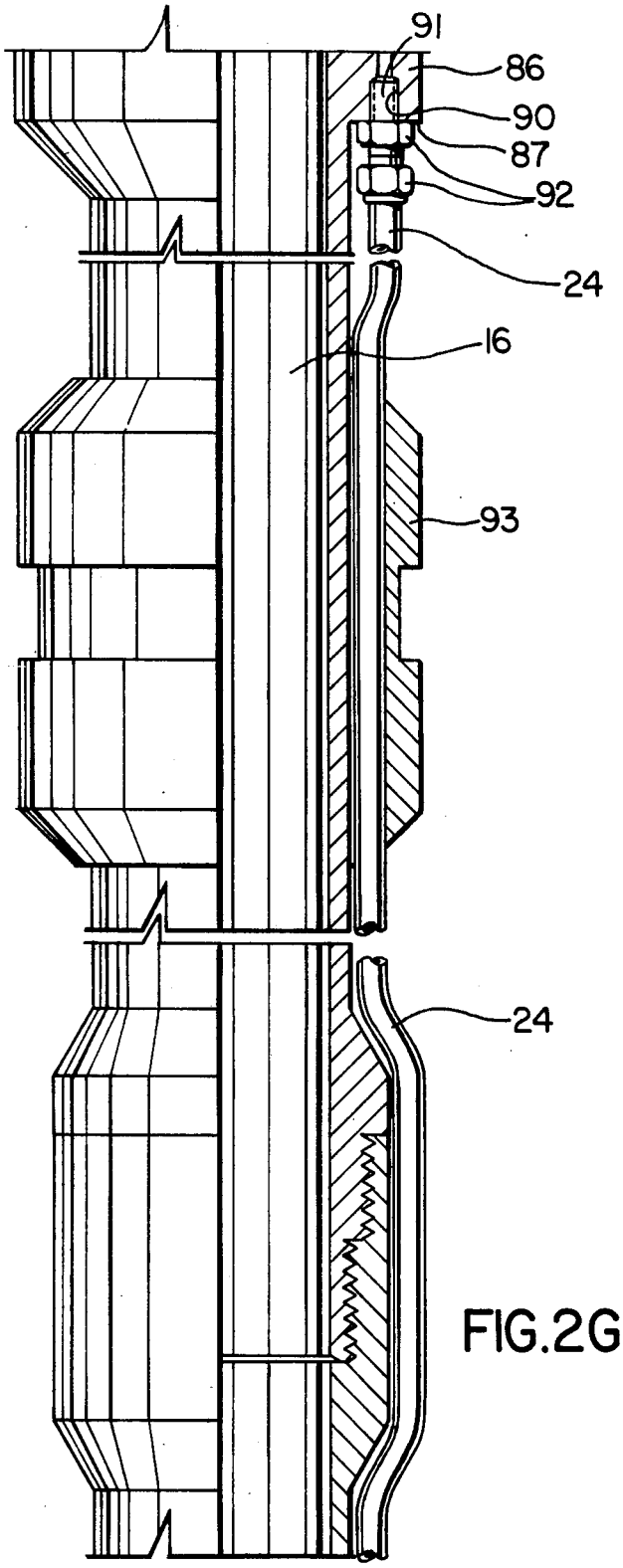
Figures 2H, 2I:
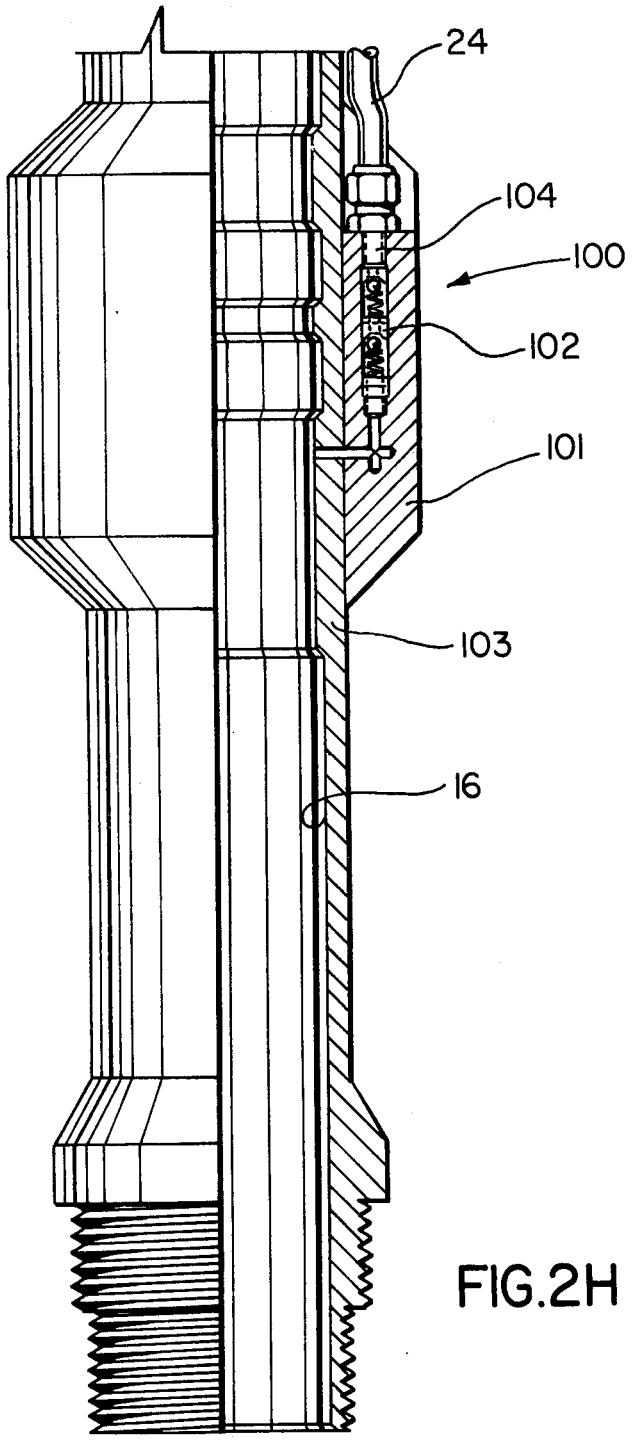

The lower end 55 of the well 49 in the housing 33 is provided with a longitudinal port 56 to connect with a radial port 57 through the housing 35 which connects with a similar, aligned radial port 58 in the collar 59 of the slick joint 15. The collar 59 is provided with a longitudinal port 60 which is operatively joined to an external tube 61 (FIG. 2D) welded in a longitudinal slot 62 in the interconnecting conduit 63 of the slick joint 15. The exposed ends 571, 601 of bores 57, 60 respectively are capped with blind caps 572, 602 to assure substantially leak free internal porting. The welded external tube 61 is then operatively connected at the lower end of slot 62 to a longitudinal port 65 down the lower collar 64 of the slick joint 15 which (FIG. 2D), in turn, is connected to the upper sub 19 of the fluted hanger assembly 18 (FIG. 2E). The lower collar 64 of the slick joint 15 is connected to the upper sub 19 of the fluted hanger assembly 18 by conventional packing means 66 to provide a fluid-tight seal.

The upper sub 19 of the fluted hanger assembly is provided with an upwardly extending internal longitudinal port 67 (FIG. 2E) which is intersected by a lower radial internal port 68 and an upper radial internal port 69 interconnecting the internal porting 65 of the lower collar 64 of the slick joint 15 to the internal port 70 in the upper tubular end 71 of the lower sub 20 of the fluted hanger assembly 18.

Radial port 69 connects to port 65 in the lower collar 64 to effect good fluid flow. Similarly, a connecting radial port 705 is provided in the upper end 71 of lower sub 20. To prevent leakage substantially completely end 691 of port 69, end 631 of port 65, end 681 of port 68, upper end 701 of port 70 and lower end 671 of port 67 are provided with blind caps 692, 632, 682, 702 and 672 respectively.

The upper sub 19 is provided with a downwardly depending concentric connecting tube 72 which interconnects the tubular upper end 71 of the lower sub assembly 20 in a sealed fashion using seals 721.

The sub-sea test tree 10 is supported by means of a fluted hanger assembly 18 which includes a hanger 73 (FIG. 2F) supported on a portion of the well housing, which is provided with a frusto-conical central aperture 74 supporting a main frusto-conical shape in hanger 73. The hanger 73 is connected between shoulders on the lower end of upper sub 19, and lower sub 20, which passes through a central aperture 78 in the hanger 73. The hanger 73 is provided with longitudinal bored channels 751 connecting to the well bore.

As noted, the upper end 71 of the lower sub 20 is provided with a longitudinally extending internal porting bore 70 which extends downwardly as far as the main tubular section 79 of the lower sub 20. The lower end 80 of the main tubular section 79 is similarly provided with an internal port 81, which is connected, at its upper extremety with the internal port 70 within the upper tubular extension 71 by means of a radial port 82, which is provided at its outer end 821 with a blind cap 822 to prevent fluid leakage.

The lower tubular extension of the lower sub 20 is likewise provided with an internal longitudinal port 83 which interconnects the internal port 81 in the main portion 79 of the lower sub 20 via radial port 84. The open end 841 of bore 84 is capped with a blind cap 842.

The test string 16 is connected to the lower sub 20 by a crossover sub 21. The upper end 85 of main tubular portion 86 of cross over sub 21 is connected to the lower tubular extension 82 of the lower sub 20 by threaded inter-engagement coupled with the usual packing means to prevent fluid leakage. The crossover sub 21 is provided with a longitudinal internal port 88 connected to a radial port 89 in the upper end 86 of cross over sub 21. Radial port 89 connects to aligned axial port 83 in lower extension 82 to provide a connection between ports 83 and 88. The open ends 831 and 891 are capped with blind caps 832 and 892 respectively. The internal port 88 is provided with an enlarged seating well 90 at shoulder 87 (FIG. 2G) within which the pin end 91 of a threaded tubing connector 92 is seated. The tubing connector comprises the upper end of a second string 24 of external tubing which now extends downwardly alongside the testing string 16 to the methanol injection joint. The external tubing 24 is secured to the testing string 16 and is protected by a plurality of tubing protectors 93. These tubing protectors 93 substantially prevent damage from wear and/or impact on the tubing 24 as the system is being run into, or out of, the well. The tubing protectors 93 also provide a friction grip both on the testing string 16 and on the external tubing 24 so that relative movement does not occur.

At any selected depth in the well, a methanol injection system 100 (FIG. 2H) is provided, contained in a protective housing 101 to protect the tubing from vertical and side impact. The methanol is injected through a dual fail closed valve 102, fixed in a pup joint of sub 103 to be connected to the test string 16 and the external tubing 23. The valve 102 is preferably a check-type and provides bubble-tight seal against well fluids.

In order to protect the system in the event of mechanical failure, a nipple profile 104 is provided within the pup joint which receives a wire line seal mandrel (not seen) with a flow-through passage. In the event of mechanical failure in the injection system, the wire line seal mandrel is run to plug the injection ports.

In order to provide adequate connection with fluid-tight seals between the external tubing and internal porting connections, dual mechanical connections are provided. Fixed tubing seals are obtained through metal/metal contact. Removable fitting seals are obtained by means of straight threads, a locking mechanism and a resilient seal.

While not shown, tubing protectors are provided immediately above and immediately below all the test string joints where external tubing is provided.

Thus, by aspects of this invention, the methanol flow path is by way of external tubing from the rig floor down to the upper sub-sea tree assembly, where it is connected to an internal porting in the lower housing of the lower sub-sea tree assembly and in the upper tubular extension of the slick joint. It then flows through tubing welded in a slot in the slick joint. The path is then internally through the lower collar of the slick joint, the upper sub, the lower sub and the crossover sub. Then the flow is by lower external tubing to the dual fail closed methanol injection check valve.

Now referring to this description in more general terms, starting at the lower most point i.e. of injection of the methanol into the test string, the system includes an injection valve assembly. Methanol is injected at any suitable depth below the sea floor. At this point a dual fail closed valve is provided and is fixed to a pup joint or sub for insertion in the test string. The valve is a check type and provides a bubble-tight seal against gas. The valve is contained in a protective housing or machined block with a major dimension of the entire valve and pup assembly being limited to the drift diameter of the well casing. In addition, adequate flow-by area between the casing and the valve is maintained. The connection to the injection tubing is protected from vertical or side impact and does not rely on tapered threads to achieve a seal. Straight threads may be used along with a resilient static seal.

A system is also provided to protect the methanol injection system in the event of mechanical failure. Such system includes a nipple profile provided within the pup joint to receive a wire line seal mandrel. The wire line seal mandrel is run to plug the injection ports in the even of a mechanical failure in the injection system.

The injection tubing preferably has a working pressure of 10,000 psi or greater and a burst pressure of 15,000 psi or greater. The tubing size is selected to limit the frictional losses preferably to 500 psi at any operating pressure and at a methanol injection rate of at least 1.0 g pm. The tubing is preferably spooled to ease handling and minimize connections. Two spooled lengths are preferably provided: one length is installed below the fluted hanger assembly and one length is installed from the sub-sea test tree to the rig floor. Tubing connections i.e. external/internal are preferably a dual mechanical type with the fixed tubing seals obtained through a metal-to-metal contact and the removable fitting seals obtained through the use of straight threads, a locking mechanism and a resilient seal. Tubing protectors are provided immediately above and also immediately below the test string joints to prevent side and vertical wear or impact on the tubing as the system is being run in or out of the hole. The protectors are easily applied and also provide a friction grip on the production string so that relative movement will not occur.

As described hereinbefore the freezing point depressant flow path is provided with internal porting of the fluted hanger assembly, the slick joint and the lower portion of the sub-sea tree. The flow path is achieved according to an aspect of this invention without interrupting the functional use of any component by effecting certain essential changes.

A crossover sub is provided below the fluted hanger assembly to change the flow path from internal porting to external tubing. Internal porting is provided in the lower hanger sub of the fluted hanger assembly to obtain a flow path through the hanger seat area. Internal porting for the upper sub of the fluted hanger assembly is also provided to crossover from the slick joint connection to the lower sub. In one aspect of this invention, it was found to be necessary to provide a larger diameter sub to accommodate the larger slick joint connection.

In another aspect of this invention, the slick joint diameter may need to be increased in size to accommodate larger rams, and a triple seal, an external slot preparation and a length of tubing may be welded into the slot to connect with the internal porting at each pin end. The slot is provided with an original slick area to allow the blowout preventor rams to seal when they are closed.

In a preferred aspect, a larger lower housing is provided for the valve assembly to provide a seat for a freezing point depressant pin connector. The housing also provides both this function and centralizes and protects the injection system components as they are being run in and out of the well bore. The housing extends to a diameter of up to the centralizer diameter for the blowout preventor system as necessary to accommodate the pin and box connector assembly.

The upper subsea tree assembly is provided to accommodate the freezing point depressant box connector. The box is held loosely in position by a protective housing to allow for slight misalignment of the two subsea tree assemblies as the pin and box connectors mate. The housing also provides course and fine alignment when connecting the two subsea tree assemblies through the use of one double dimensioned keyway. The key is mounted on the lower subsea tree assembly housing and is prevented from experiencing shear forces by being seated on the lower housing. The key dimensions provide final alignment before the pin enters the box connector.

What we claim is:

1. In combination, an assembly connected to an offshore well for producing oil and/or gas, said well having a test string extending therethrough, and including a sub-sea test tree, said assembly including at least one line having one end in communication with a supply of a freezing point depressant and having the other end in communication with said test string below the sea floor, said line being substantially parallel to said test string and comprising the combination of: upper and lower external tubing; tubing protectors mechanically associated with the external tubing and the test string; internal porting of selected intermediate sections of said sub-sea test tree, thereby not interrupting the functional use of any component; unlatch/latch connection means for detachably connecting the upper external tubing to the upper internal porting; and a lower freezing point depressant injection check valve disposed below said sea floor for admitting the freezing point depressant into the test string while providing a bubble-tight seal against gas.

2. The assembly of claim 1 wherein said unlatch/latch connection means comprises a pin and box connector.

3. The assembly of claim 1 wherein the connections between the external tubing and the internal porting comprise static resilient and mechanical type seals.

4. The assembly of claim 1 wherein tubing protectors are provided in the vicinity of the test string joints.

5. The assembly of claim 4 wherein the tubing protectors are provided immediately above and immediately below the production string joints and between the joints.

6. The assembly of claim 1 wherein the check valve is a dual, fail closed valve.

7. The assembly of claim 6 wherein said valve is contained in a protective housing disposed within the well casing.

8. The assembly of claim 6 wherein the connection to the injection tubing is protected from vertical and side impacts and is provided with a resilient static seal.

9. The assembly of claim 1 including means for plugging at least one injection port in the freezing point depressant flow path system in the event of mechanical failure in the injection system.

10. The assembly of claim 1 wherein the freezing point depressant is methanol.

11. An assembly connected to an offshore well for producing oil and/or gas, said well having a test string extending therethrough and including a sub-sea test tree, said assembly including at least one line having one end located on a surface rig connected to a supply of a freezing point depressant and having the other end located below the sea floor in said test string, said line comprising: upper external tubing extending from said surface rig to said sub-sea test tree; lower external tubing extending from below said sub-sea test tree toward said other end of said line; and, internal conduits in selected intermediate sections of said sub-sea test tree, said internal conduits being connected to said upper external tubing and said lower external tubing, whereby the functioning of any component is not interrupted.

12. The assembly of claim 11 and including means associated with said line at said other end of said line for injecting the freezing point depressant into said test string.

13. A method of preventing hydrate plug formation in production testing of an offshore oil and/or gas well having a test string extending therethrough and including a sub-sea test tree, said method comprising:

providing a line having one end located on a surface rig of an offshore oil and/or gas well and having the other end located below the sea floor in the test string, the line comprising upper external tubing extending from the surface rig to the sub-sea test tree, lower external tubing extending from below the sub-sea test tree toward the other end of the line below the sea floor, and internal conduits in selected intermediate sections of the sub-sea test tree, the internal conduits being connected to the upper external tubing and the lower external tubing;

injecting a freezing point depressant into the line at the surface rig;

directing the freezing point depressant through the line from the surface rig through the upper external tubing, through the internal conduits, and through the lower external tubing below the sea floor; and, injecting the freezing point depressant from the lower external tubing into the test string of the well below the sea floor.

14. The method of claim 13 wherein the freezing point depressant is methanol.

15. The method of claim 14 wherein said injecting steps comprise injecting the methanol at an injection rate of at least 1.0 gpm.

* * * * *